United States Patent [19]

Heiser et al.

[11] Patent Number: 4,925,340

[45] Date of Patent: May 15, 1990

[54] SCREED SLOPE CONTROLLER FOR A PAVER

[75] Inventors: Richard K. Heiser, Wayzata; James R. Reed, Minneapolis, both of Minn.

[73] Assignee: Sundstrand-Sauer, Ames, Iowa

[21] Appl. No.: 351,379

[22] Filed: May 12, 1989

[51] Int. Cl.[5] ..... E01C 23/01

[52] U.S. Cl. ..... 404/75; 404/84; 404/118

[58] Field of Search ..... 404/84, 118, 75; 172/4.5; 425/456

[56] References Cited

U.S. PATENT DOCUMENTS

| | | | |
|---|---|---|---|
| Re. 27,899 | 1/1974 | Burgin | 172/430 |
| 3,334,560 | 8/1967 | Long et al. | 404/84 |
| 3,674,094 | 4/1972 | Kuntz | 172/4.5 |
| 3,782,844 | 1/1974 | Burgin | 404/84 |
| 3,791,452 | 2/1974 | Long et al. | 172/4.5 |
| 3,872,601 | 3/1975 | Burgin | 404/84 X |
| 3,879,149 | 4/1975 | Smith et al. | 404/72 |
| 3,899,028 | 8/1975 | Morris et al. | 172/4.5 |
| 4,026,658 | 5/1977 | Neuendorf et al. | 404/84 |
| 4,081,033 | 3/1978 | Bulger et al. | 172/4.5 |
| 4,156,466 | 5/1979 | Caldwell | 172/4.5 |
| 4,213,503 | 7/1980 | Elmberg et al. | 172/4.5 |
| 4,431,060 | 2/1984 | Scholl et al. | 172/4.5 |
| 4,722,636 | 2/1988 | Brock | 404/84 |
| 4,823,366 | 4/1989 | Williams | 404/84 X |

*Primary Examiner*—Jerome W. Massie
*Assistant Examiner*—Matthew Smith
*Attorney, Agent, or Firm*—Marshall, O'Toole, Gerstein, Murray & Bicknell

[57] ABSTRACT

A controller for controlling the slope of a screed supported by support arms wherein the screed is moved over a distance includes a first slope sensor which develops a first sensor signal representing the slope of the screed, a second slope sensor which develops a second sensor signal representing the slope of the support arms and a first summer which sums the first sensor signal and command signal indicative of a particular screed slope to develop a first error signal. An integrator integrates the error signal over distance to develop an integrated first error signal. A second summer sums the integrated first error signal with the second sensor signal to develop a second error signal which is utilized to control actuators which adjust the slope of the support arms.

16 Claims, 4 Drawing Sheets

SCREED SLOPE CONTROLLER FOR A PAVER

TECHNICAL FIELD

The present invention relates generally to position controllers, and more particularly to a screed slope controller for a paver.

BACKGROUND ART

Various types of pavers are available for applying material such as asphalt, concrete or the like, to a surface. A common concern in the operation of all pavers is the control of the grade and slope of the material laid on the surface. The grade is the height of the material laid with respect to a grade reference which may be a previously laid material or a string line which is sensed by a grade sensor. The slope is the side-to-side inclination of the material laid down with respect to gravity.

Towed screed pavers typically include a tractor having actuators, which may be hydraulic rams, on either side of the tractor which adjust tow points in a vertical direction. Support or tow arms having first ends are coupled to the tractor at the tow points and the second ends are coupled to either side of a screed. The screed is towed behind the tractor while a supply of material to be laid is fed ahead of the screed. The screed rests on and forms the material as the screed is towed forward and leaves a layer of material behind at the grade and slope of the screed. The tow point elevations are controlled to adjust the attack angle of the screed which ultimately determines the grade and slope of the applied material with respect to the grade reference.

Prior art automatic slope controllers for pavers control screed slope by operating the actuators to control the relative elevation of the two tow points. A change in the relative elevation of the two tow points eventually creates a change in the slope of the screed. However, the actual slope of the screed may not be exactly equal to the commanded slope due to various factors, such as manufacturing and assembly tolerances and the like. Therefore, a gravity or other slope sensor has been provided on the screed. Such controllers have, however, been found to be unstable in operation due to system response delay. This delay is present because the screed cannot instantaneously change slope in response to a change in relative elevation of the two tow points.

In order to overcome the foregoing problem, it has been proposed to use a slope sensor supported by the tow arms at a point forward of the screed. Such a sensor is disclosed in Burgin, U.S. Pat. No. 3,782,844. However, in such prior controllers having a slope sensor on the tow arms, the slope signal does not represent the actual slope of the screed but the slope (i.e., the difference in elevation) of the tow arms at the points of support of the sensor. As a result, an error is introduced into the controller which reduces positioning accuracy.

SUMMARY OF THE INVENTION

In accordance with the present invention, a controller for a paver is capable of stable and accurate operation.

More particularly, a controller for controlling the slope of a screed supported by support arms includes first means for developing a first sensor signal representing the slope of the screed, second means for developing a second sensor signal representing the slope of the support arms and a first summer which sums the first sensor signal and a command signal indicative of a particular desired screed slope to develop a first error signal. An integrator integrates the first error signal over distance to develop an integrated error signal and a second summer sums the integrated error signal with the second sensor signal to develop a second error signal. An actuator controller is provided to adjust the slope of the support arms in response to the magnitude of the second error signal.

In the preferred embodiment, the first developing means is located on the screed and the second developing means is located between the support arms at a particular point along the length of the arms.

The present screed slope controller overcomes the accuracy and stability problems encountered by the prior art controllers by using sensors positioned on the screed and on the tow arms.

BEST MODE FOR CARRYING OUT INVENTION

Figure 1:
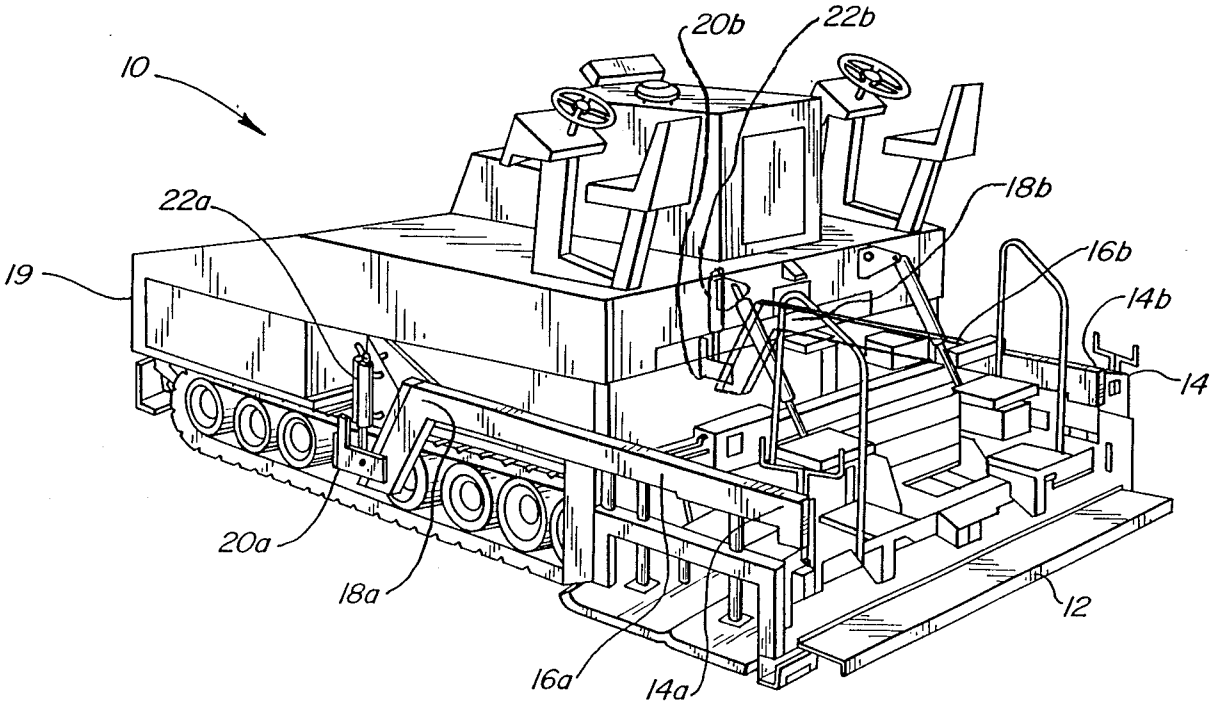
FIG. 1 is a perspective view of a paver which can be adapted to incorporate a controller according to the present invention.

Referring now to FIG. 1, there is illustrated a paver 10 having a screed 12 secured to first ends 14*a*,14*b* of support or tow arms 16*a*,16*b*. The arms 16*a*,16*b* also include second ends 18*a*,18*b* connected to a tractor 19 at tow points 20*a*,20*b*. The elevations of the tow points 20*a*,20*b* are controlled by actuators such as hydraulic rams 22*a*,22*b*. The rams 22*a*,22*b* may be replaced by motorized jack screws, if desired. The elevations of the tow points 20*a*,20*b* are adjusted to position the screed 12 at a particular grade with respect to a grade reference and to position the screed 12 at a particular slope.

Figure 2:
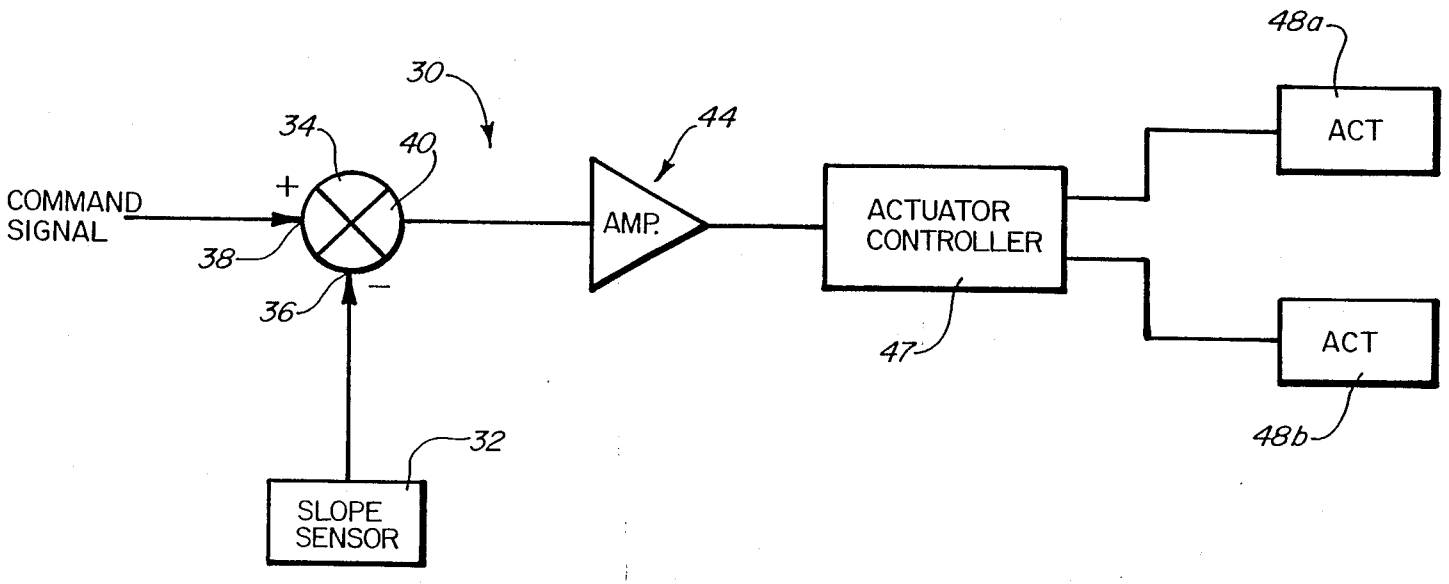
FIG. 2 PRIOR ART
FIG. 2 comprises a combined block and schematic diagram of a prior art slope controller.

Referring now to FIG. 2, there is shown a prior art automatic slope controller 30 which includes a slope feedback sensor 32 that develops a slope signal. The slope feedback sensor 32 is supported between and from the tow arms 16*a*,16*b*, and hence the slope signal represents the sensed transverse slope between the tow arms 16*a*,16*b*. A summer 34 includes an inverting input 36 which receives a command signal representing desired screed transverse slope. The summer 34 sums the command signal and the slope signal and develops an error signal at an output 40. The error signal is coupled to an amplifier 44 and an actuator controller 47 which in turn operates the two actuators 22*a*,22*b*. The two actuators 22*a*,22*b* determine the elevation of the tow points 20*a*,20*b*.

As previously mentioned, the prior art controller 30 has been found to be inaccurate in operation. This is due to the fact that the feedback signal is representative of the difference in tow arm elevations but not the true transverse slope of the towed screed.

Figure 3:
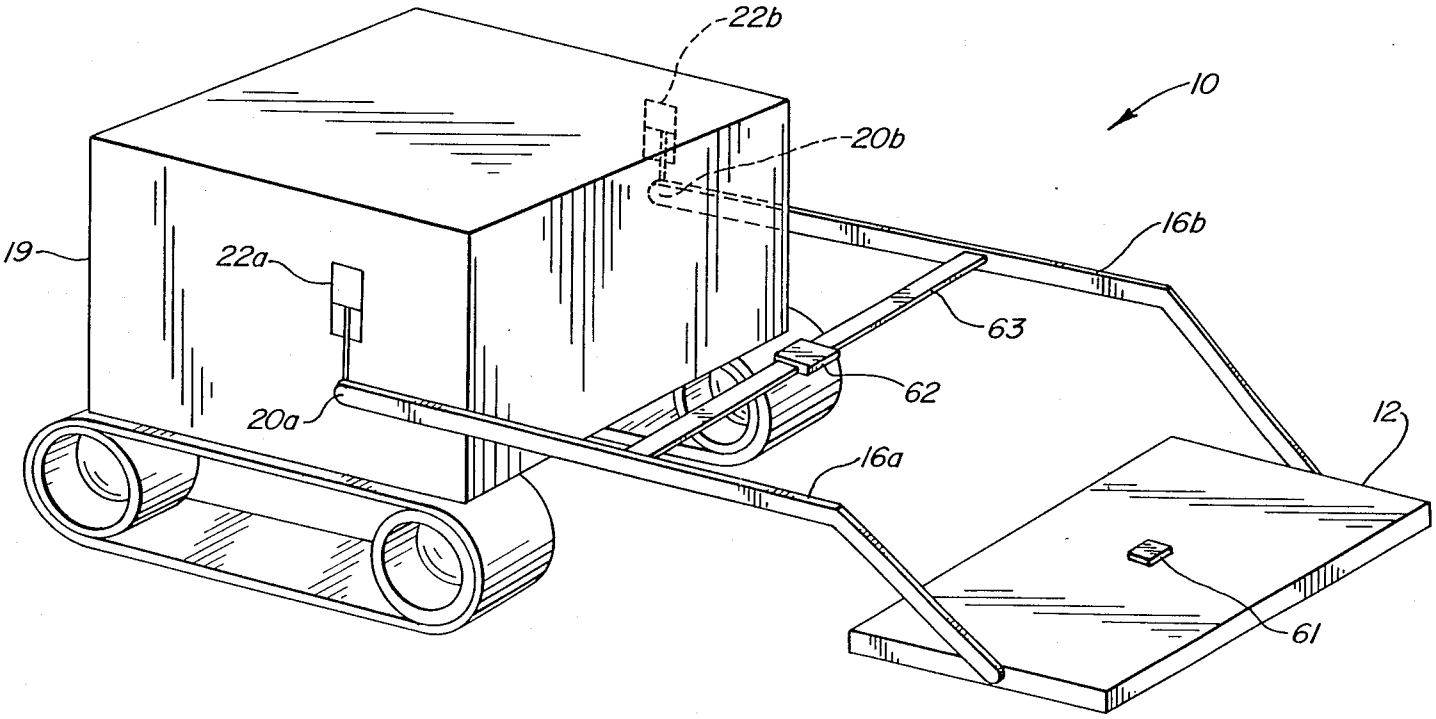
FIG. 3 is a simplified diagrammatic view of the paver of FIG. 1.
Figure 4:
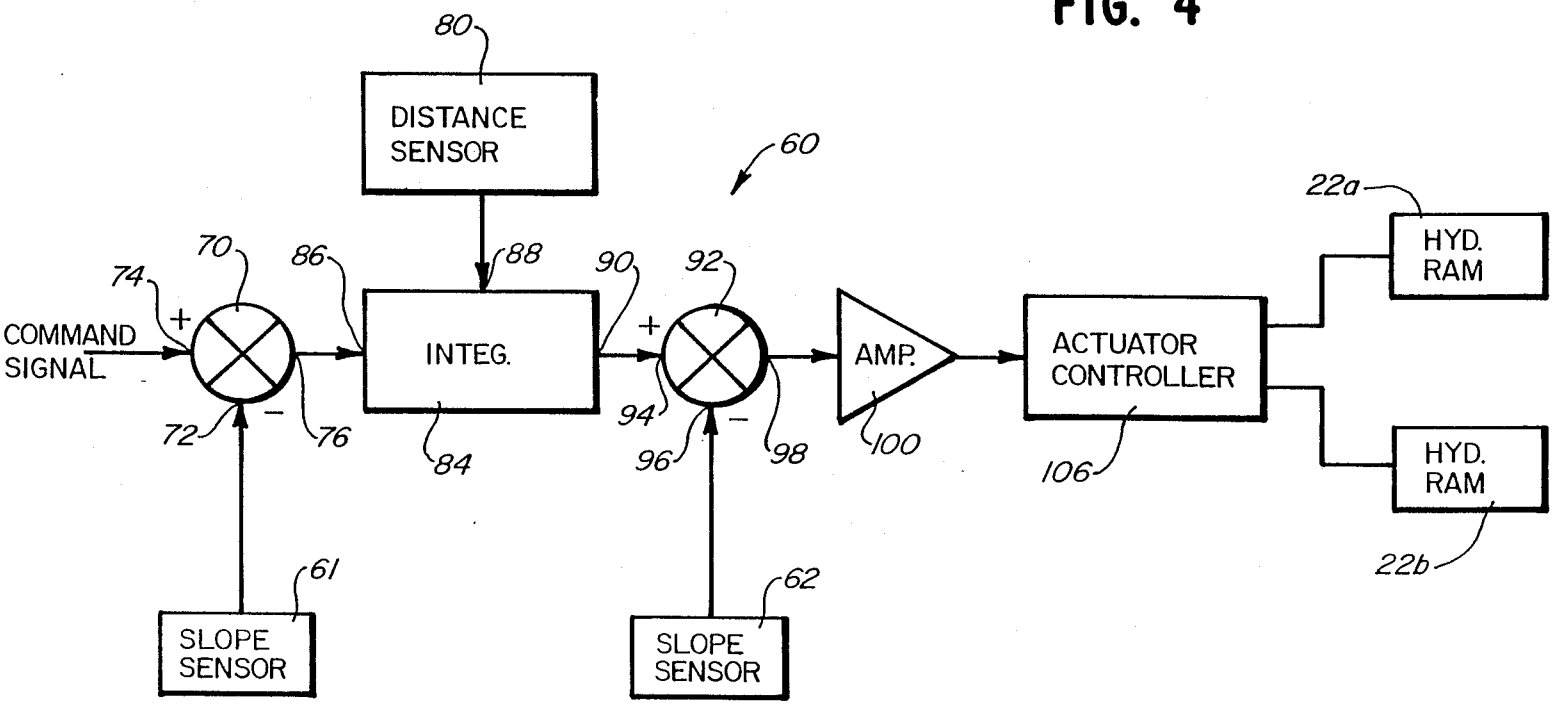
FIG. 4 comprises a combined block and schematic diagram of the controller of the present invention.

Referring now to FIG. 3, the paver 10 is shown in simplified form to better illustrate the relative positions of the elements and sensors used in a paver having the controller 60 of the present invention. The controller 60 is illustrated in FIG. 4. The same reference numerals from FIG. 1 are used in FIG. 3 to indicate identical elements.

A first sensor 61 is located on the screed 12 and develops a first sensor signal representing the transverse slope of the screed 12. A second sensor 62 is supported between and from the tow arms 16*a*,16*b*by means of a bar 63 which is welded or otherwise secured to the arms 16*a*,16*b* and develops a second sensor signal representing the transverse slope of the tow arms 16*a*,16*b* at the bar 63. The first and second sensors 61,62 may comprise pendulum type gravity sensors, such as accelerometers or the like.

Preferably, each end of the bar 63 is secured at a particular point along the length of one of the arms 16*a*,16*b*. Typically, these points are selected so that the bar 63 and sensor 62 can be accommodated by the paver 10. Usually, this requires that the bar be secured at points located in the middle third of the arms 16*a*,16*b*, although the bar 63 may instead be secured forward or aft of such points, if necessary or desirable. The first and second sensors 61,62 may comprise pendulum-type gravity sensors, such as accelerometers or the like.

Referring to FIG. 4, the controller 60 includes a first summer 70 having an inverting input 72 which receives the first sensor signal, a non-inverting input 74 which receives a slope command signal and an output 76 at which is developed a first error signal representing the difference between the command signal and the first sensor signal. A distance sensor 80 develops a distance signal representing the distance traveled by the paver 10. The distance sensor 80 may comprise an optical shaft encoder coupled to a drive shaft (not shown) of the paver 10. An integrator 84 includes a first input 86 which receives the first error signal, a second input 88 which receives the distance signal and an output 90 at which is developed an integrated error signal representing the first error signal integrated over distance.

A second summer 92 includes a non-inverting input 94 which receives the integrated error signal, an inverting input 96 which receives the second sensor signal and an output 98 at which the second error signal is developed. The second error signal is coupled by an amplifier 100 to an actuator controller 106 which in turn controls the rams 22*a*,22*b*.

As should be evident from the foregoing, the integrated error signal, in reality, forms a command signal for the tow arm slope control loop comprising the summer 92, the amplifier 106 and the slope sensor 62. As previously noted, the integrated error signal, in turn, represents the screed slope error integrated over distance. Thus, the tow arm slope control loop operates the actuators 22*a*,22*b* to adjust the tow arm slope in response to integrated screed slope error. Thus, screed slope positioning is accomplished in stable fashion and with a high degree of accuracy.

We claim:

1. A controller for controlling the slope of a screed supported by support arms wherein the screed is moved over a distance, comprising:

first means for developing a first sensor signal representing the slope of the screed;

second means for developing a second sensor signal representing the slope of the support arms;

third means coupled to the first developing means for developing an integrated error signal from the first sensor signal and a slope command signal indicative of a desired screed slope;

a summer coupled to the second and third developing means which sums the integrated error signal with the second sensor signal to develop a second error signal; and means responsive to the second error signal for adjusting the slope of the support arms.

2. The controller of claim 1, wherein the third developing means includes a further summer which develops an output representing the sum of the first sensor signal with the slope command signal and an integrator coupled to the further summer which integrates the output of the further summer over distance.

3. The controller of claim 1, wherein the first developing means is located pn the screed.

4. The controller of claim 1, wherein the second developing means is located between the support arms.

5. The controller of claim 4, wherein the support arms have a certain length and the second developing means is disposed on a bar having ends mounted at points located in the middle third of the support arms.

6. A controller for controlling the slope of a screed towed by tow arms connected to a tractor at tow points wherein the screed is towed over a distance and wherein the elevations of the tow points are adjustable, comprising:

a first slope sensor for developing a first sensor signal representing the transverse slope of the screed;

a second means slope sensor for developing a second sensor signal representing the slope of the tow arms;

a first summer coupled to the first slope sensor which sums the first sensor signal and a slope command signal indicative of a particular desired screed slope to develop a first error signal;

an integrator coupled to the first summer which integrates the first error signal over distance to develop an integrated error signal;

a second summer coupled to the integrator and the second slope sensor which sums the integrated error signal with the second sensor signal to develop a second error signal; and means coupled to the second summer and responsive to the second error signal for adjusting the relative elevation of the tow points.

7. The controller of claim 6, wherein the first slope sensor is located on the screed.

8. The controller of claim 6, wherein the second slope sensor is located between the tow arms.

9. The controller of claim 8, wherein the tow arms have a certain length and the second slope sensor is disposed at a point within the middle third of the length of the tow arms.

10. The controller of claim 6, further including means coupled to the integrator for developing a distance signal representing the distance over which the screed is towed.

11. The controller of claim 6, wherein the adjusting means includes an actuator connected to each tow point.

12. The controller of claim 11, wherein the actuators are hydraulic rams.

13. The controller of claim 6, wherein the first and second slope sensor means are pendulum-type gravity sensors.

14. A method of controlling the slope of a screed towed over a distance by a tractor having tow arms connected to the tractor at tow points wherein the elevations of the tow points are adjustable, comprising the steps of:

developing a first sensor signal representing the transverse slope of the screed;

developing a second sensor signal representing the transverse slope of the tow arms at a particular point along the tow arms;

summing the first sensor signal and a slope command signal representing a particular desired screed slope to develop a first error signal;

integrating the first error signal over distance to develop an integrated error signal;

summing the integrated error signal with the second sensor signal to develop a second error signal; and operating an actuator connected to each tow point to adjust the relative elevations thereof in accordance with the second error signal to in turn control the slope of the screed.

15. The method of claim 14, wherein the step of developing the second sensor signal includes the step of providing a slope sensor on a bar having ends connected to the tow arms.

16. The method of claim 15, wherein the step of providing includes the step of securing the ends of the bar to the tow arms at points which are disposed in the middle third of the length of the tow arms.

* * * * *